US007835683B2

(12) United States Patent
Muraishi et al.

(10) Patent No.: US 7,835,683 B2
(45) Date of Patent: Nov. 16, 2010

(54) CLEANING UNIT, IMAGE CARRYING UNIT AND IMAGE FORMING APPARATUS USING THE SAME

(75) Inventors: Takaya Muraishi, Kawasaki (JP); Takeshi Shintani, Kawasaki (JP); Yasushi Akiba, Yokohama (JP); Satoshi Hatori, Yokohama (JP); Akio Kosuge, Yokohama (JP); Kaoru Yoshino, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 72 days.

(21) Appl. No.: 12/273,224

(22) Filed: Nov. 18, 2008

(65) Prior Publication Data

US 2009/0142115 A1 Jun. 4, 2009

(30) Foreign Application Priority Data

Nov. 30, 2007 (JP) ..... 2007-311339

(51) Int. Cl.
*G03G 21/00* (2006.01)
*G03G 21/10* (2006.01)

(52) U.S. Cl. ..... 399/358; 15/256.52; 399/350

(58) Field of Classification Search ..... 399/358, 399/359, 360, 350, 98, 99, 100, 101, 256; 15/1.51, 256.5, 256.51, 256.52
See application file for complete search history.

(56) References Cited

U.S. PATENT DOCUMENTS

| | | | | |
|---|---|---|---|---|
| 4,803,513 | A * | 2/1989 | Nishise et al. | 399/261 |
| 5,878,317 | A | 3/1999 | Masuda et al. | 399/359 |
| 6,249,665 | B1 * | 6/2001 | Yuge et al. | 399/358 |
| 6,505,022 | B2 | 1/2003 | Kosuge et al. | 399/159 |
| 6,560,438 | B2 | 5/2003 | Kosuge | 399/350 |
| 6,567,637 | B2 | 5/2003 | Yanagisawa et al. | 399/258 |
| 6,577,842 | B2 | 6/2003 | Akiba et al. | 399/359 |
| 6,768,879 | B2 | 7/2004 | Kosuge | 399/53 |
| 6,868,252 | B2 | 3/2005 | Akiba | 399/354 |

(Continued)

FOREIGN PATENT DOCUMENTS

JP 7-160167 6/1995

(Continued)

OTHER PUBLICATIONS

Machine translation of JP 07-160167 A dated Mar. 24, 2010.*

*Primary Examiner*—Sophia S Chen
(74) *Attorney, Agent, or Firm*—Oblon, Spivak, McClelland, Maier & Neustadt, L.L.P.

(57) ABSTRACT

A cleaning unit includes a cleaning member, an ejection member, a delivering member, and a flicker. The cleaning member contacts an object to be cleaned moving in a given direction, and removes waste material from the object to be cleaned. The ejection member, disposed in an area distanced from the object to be cleaned, transports the waste material removed from the object to be cleaned to outside of the cleaning unit. The delivering member delivers the waste material to a transport-effective area of the ejection member. The delivering member includes a vane rotating device including a rotation axis and a vane attached on the rotation axis. The vane rotating device rotates to deliver the waste material to the ejection member. The flicker contacts a free end of the vane to cause a flicker movement to the vane at a position over the transport-effective area of the ejection member.

14 Claims, 5 Drawing Sheets

U.S. PATENT DOCUMENTS

| | | | | |
|---|---|---|---|---|
| 7,050,741 | B2 | 5/2006 | Koike et al. | 399/159 |
| 7,062,194 | B2 | 6/2006 | Yanagida et al. | 399/100 |
| 7,065,316 | B2 | 6/2006 | Yanagida et al. | 399/350 |
| 7,085,528 | B2 | 8/2006 | Shintani et al. | 399/350 |
| 7,110,696 | B2 | 9/2006 | Murakami et al. | 399/101 |
| 7,130,564 | B2 | 10/2006 | Murakami et al. | 399/129 |
| 7,139,504 | B2 | 11/2006 | Yanagida et al. | 399/100 |
| 7,149,465 | B2 | 12/2006 | Amemiya et al. | 399/346 |
| 7,218,877 | B2 | 5/2007 | Yanagida et al. | 399/100 |
| 7,228,099 | B2 | 6/2007 | Shitani et al. | 399/346 |
| 7,263,308 | B2 | 8/2007 | Harada et al. | 399/100 |
| 7,266,324 | B2 | 9/2007 | Yanagida et al. | 399/100 |
| 7,272,354 | B2 | 9/2007 | Murakami et al. | 399/347 |
| 7,289,748 | B2 | 10/2007 | Yanagisawa et al. | 399/106 |
| 7,292,816 | B2 | 11/2007 | Ojimi et al. | 399/346 |
| 7,295,796 | B1 | 11/2007 | Murakami et al. | 399/258 |
| 7,302,197 | B2 | 11/2007 | Kosuge | 399/27 |
| 7,386,257 | B2 | 6/2008 | Koike et al. | 399/159 |
| 7,430,377 | B2 | 9/2008 | Koike et al. | 399/12 |
| 2002/0025202 | A1* | 2/2002 | Itaya et al. | 399/350 |
| 2005/0164108 | A1 | 7/2005 | Murakami et al. | 430/97 |
| 2005/0191574 | A1 | 9/2005 | Koike et al. | 430/109.4 |
| 2005/0232665 | A1 | 10/2005 | Toshio et al. | 399/346 |
| 2005/0238396 | A1* | 10/2005 | Lee | 399/358 |
| 2006/0088337 | A1* | 4/2006 | Nakazato et al. | 399/116 |
| 2007/0009293 | A1 | 1/2007 | Akiba et al. | 399/350 |
| 2007/0036595 | A1 | 2/2007 | Amemiya et al. | 399/346 |
| 2007/0048050 | A1* | 3/2007 | Fahmy et al. | 399/358 |
| 2007/0071525 | A1 | 3/2007 | Yoshino et al. | 399/346 |
| 2007/0154246 | A1 | 7/2007 | Shintani et al. | 399/346 |
| 2007/0280724 | A1* | 12/2007 | Park | 399/100 |
| 2008/0013986 | A1 | 1/2008 | Kosuge | 399/159 |
| 2008/0069614 | A1 | 3/2008 | Shintani et al. | 399/346 |

FOREIGN PATENT DOCUMENTS

| | | |
|---|---|---|
| JP | 2002-72810 | 3/2002 |
| JP | 2005-338880 | 12/2005 |

* cited by examiner

CLEANING UNIT, IMAGE CARRYING UNIT AND IMAGE FORMING APPARATUS USING THE SAME

CROSS-REFERENCE TO RELATED APPLICATIONS

This application claims priority under 35 U.S.C. §119(a) to Japanese Patent Application No. 2007-311339, filed on Nov. 30, 2007 in the Japan Patent Office, the entire contents of which are hereby incorporated by reference herein.

BACKGROUND OF THE INVENTION

1. Field of the Invention

The present invention generally relates to a cleaning unit used for an image forming apparatus, such as a copier, a facsimile, or a printer, and an image forming apparatus and an image carrying unit including the cleaning unit.

2. Description of the Background Art

In general, image forming apparatuses using electrophotography include a photoconductor to form a latent image and a visible toner image developed with the use of toner, for example. In such image forming apparatuses, waste materials (e.g., excess toner) remaining on the photoconductor may be removed by a cleaning unit after a process of transferring the toner image. The cleaning unit may employ a blade-cleaning method, in which a blade, typically made of rubber, is contacted against the photoconductor to remove toner from the photoconductor.

In such a blade-cleaning method, the cleaning unit generally includes a cleaning blade and a brush roller, wherein the brush roller is located upstream from the cleaning blade in a surface moving direction of the photoconductor and is used to assist in cleaning function of the blade.

Further, the cleaning unit may include an ejection member, for example a toner recovery coil, to transport waste materials (e.g., excess toner) removed from the surface of the photoconductor to a transport route outside of the cleaning unit. The waste materials transported to the transport route may be further transported to a development unit or a waste toner bottle, for example, as in Japanese Patent Application Publication No. 2005-338880 (hereinafter "JP-2005-338880-A").

In general, toner removed by the cleaning blade drops from where the cleaning blade contacts the photoconductor. Accordingly, it is preferable to dispose the toner recovery coil at such a location.

However, the photoconductor is typically surrounded by several other units (e.g., a charge unit, a development unit, a transfer unit, etc.), which need to be placed around the photoconductor in addition to the cleaning unit. Accordingly, it may be difficult to allocate a greater space only for the cleaning unit.

In light of such configuration, the cleaning unit may include a supplemental transport member for transporting the removed toner to a transport-effective area of the toner recovery coil (referred as "an exhaust transport route").

Thus, for example, in JP-2005-338880-A, the cleaning unit includes a cleaning blade, a separation unit, and a toner recovery coil. In such a configuration, toner removed by the cleaning blade drops to the brush roller placed beneath a location where the cleaning blade contacts the photoconductor. In such a configuration, the brush roller is used as a supplemental transport member to transport toner to a transport-effective area of the toner recovery coil, and the separation unit is used for separating toner adhering to the brush roller at a position above the toner recovery coil.

However, use of the brush roller may involve higher manufacturing costs because brush fibers need to be wound and fixed on a metal core to manufacture the brush roller, and complex fiber processing may be required for the brush fibers.

The cleaning unit may omit a brush roller and include only a cleaning blade as a cleaning member. The cleaning performance of the cleaning blade is enhanced by using lubricant, thus striking a balance between cost and performance.

However, if the cleaning unit has no brush roller, a transport device for transporting toner removed by the cleaning blade to a transport route for ejecting toner (e.g., exhaust transport route) may be required, and in view of manufacturing cost, the transport device may need to be less expensive than the brush roller. The above described configuration and cost considerations must be taken into account when designing a cleaning unit including a cleaning member such as a blade, which contacts an object to be cleaned.

SUMMARY

A cleaning unit includes a cleaning member, an ejection member, a delivering member, and a flicker. The cleaning member contacts on a surface of a object to be cleaned that moves in a given direction, and removes waste material from the surface of the object to be cleaned. The ejection member, disposed in an area distanced from the surface of the object to be cleaned, transports the waste material removed from the object to be cleaned by the cleaning member to outside of the cleaning unit. The delivering member delivers the waste material removed from the object to be cleaned by the cleaning member to a transport-effective area of the ejection member. The delivering member includes a vane rotating device including a rotation axis and a vane. The rotation axis extends in a direction perpendicular to a surface moving direction of the object to be cleaned and the vane is made of an elastic material and attached on the rotation axis. The vane rotating device rotates to deliver the waste material to the ejection member. The flicker, made of an elastic material, contacts a free end of the vane to cause a flicker movement to the vane at a position over the transport-effective area of the ejection member.

A cleaning unit includes a cleaning member, an ejection member, and a delivering member. The cleaning member contacts on a surface of a object to be cleaned that moves in a given direction, and removes waste material from the surface of the object to be cleaned. The ejection member, disposed in an area distanced from the surface of the object to be cleaned, transports the waste material removed from the object to be cleaned by the cleaning member to outside of the cleaning unit. The delivering member delivers the waste material removed from the object to be cleaned by the cleaning member to a transport-effective area of the ejection member. The delivering member includes a vane rotating device including a rotation axis and a vane. The rotation axis extends in a direction perpendicular to a surface moving direction of the object to be cleaned and the vane is made of an elastic material and attached on the rotation axis. The vane rotating device rotates to deliver the waste material to the ejection member.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
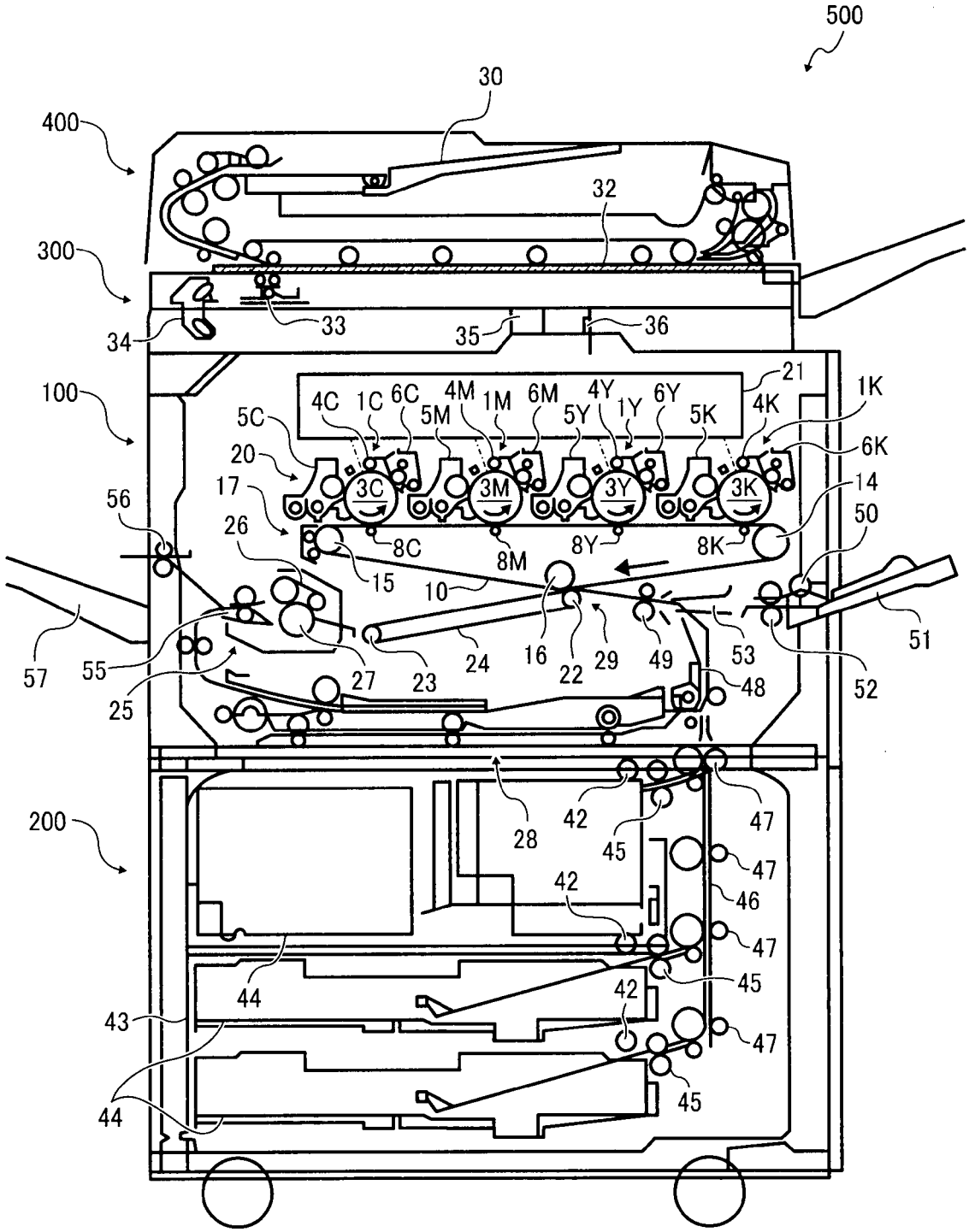
FIG. 1 illustrates a schematic configuration of an image forming apparatus according to an exemplary embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Figure 2:
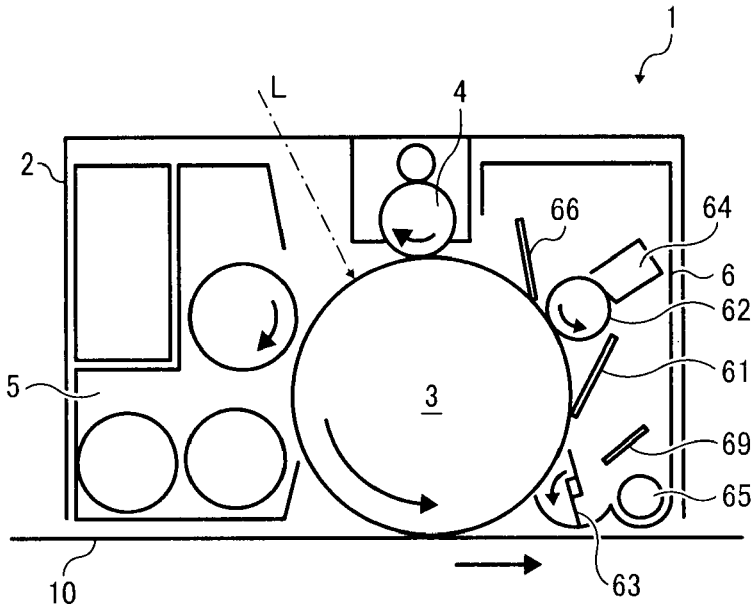
FIG. 2 illustrates a schematic configuration of an image forming engine in the image forming apparatus of FIG. 1.

Referring now to the drawings, an image forming apparatus according to an exemplary embodiment is described with respect to FIGS. 1 and 2. The image forming apparatus may employ electrophotography and may be a tandem type, for example, but is not limited thereto.

FIG. 1 illustrates a schematic configuration of an image forming apparatus 500 according to an exemplary embodiment. The image forming apparatus 500 includes a printing unit 100, a sheet feed unit 200, a scanner 300, and a document feeder 400, for example. The scanner 300 may be placed over the printing unit 100. The document feeder 400 placed over the scanner 300 may be an automatic document feeder (ADF). The image forming apparatus 500 includes a control unit to control operations of devices or components installed in the image forming apparatus 500.

The printing unit 100 includes an intermediate transfer belt 10 as an intermediate transfer member in the middle of the printing unit 100, for example. The intermediate transfer belt 10, extended by a plurality of support rollers 14, 15, and 16, can travel in a clockwise direction as shown in FIG. 2.

Further, the printing unit 100 includes photoconductors 3K, 3Y, 3M, 3C, charge units 4K, 4Y, 4M, 4C, development units 5K, 5Y, 5M, 5C, and cleaning units 6K, 6Y, 6M, 6C, for example. Suffix letters K, Y, M, and C represent the color of black (K), yellow (Y), magenta (M), and cyan (C), respectively. For each of the color of black (K), yellow (Y), magenta (M), and cyan (C), image forming engines 1K, 1Y, 1M, and 1C are configured to form an toner image, wherein the image forming units 1K, 1Y, 1M, 1C can be respectively configured with the photoconductors 3K, 3Y, 3M, 3C, the development units 5K, 5Y, 5M, 5C, the charge units 4K, 4Y, 4M, 4C, and the cleaning units 6K, 6Y, 6M, 6C. Because each of these units has a similar configuration, suffix letters K, Y, M, and C may be omitted in the following description.

The photoconductor 3 used as a latent image carrier and a toner image carrier, face the intermediate transfer belt 10. The photoconductor 3 is surrounded by the charge units 4 for uniformly charging a surface of the photoconductor 3, and the development units 5 for developing a toner image on the photoconductor 3. The cleaning unit 6 removes toner remaining on the surface of the photoconductor 3 after transferring a toner image from the photoconductor 3, wherein such a toner image transfer process may be referred as a primary transfer process.

Further, the image forming engines 1K, 1Y, 1M, and 1C can be arranged side-by-side each other to configure an image forming unit 20, which includes the image forming engines 1K, 1Y, 1M, and 1C in a tandem manner. Further, the printing unit 100 includes a belt cleaning unit 17 at a position facing the support roller 15 via the intermediate transfer belt 10. The belt cleaning unit 17 removes toner remaining on the intermediates transfer belt 10 after transferring a toner image to a recording medium (e.g., a transfer sheet), wherein such toner image transfer process may be referred as a secondary transfer process. The printing unit 100 further includes an optical writing unit 21 over the image forming unit 20.

The printing unit 100 further includes primary transfer rollers 8K, 8Y, 8M, 8C, which are disposed at an inner face side of the intermediate transfer belt 10 and faced to each of the photoconductors 3K, 3Y, 3M, and 3C via the intermediate transfer belt 10. Thus, a primary transfer nip is formed between the primary transfer roller 8 and the photoconductor 3 by sandwiching the intermediate transfer belt 10 therebetween.

The printing unit 100 further includes a secondary transfer unit 29, which is disposed at the opposite side of the intermediate transfer belt 10 with respect to the image forming unit 20. The secondary transfer unit 29 includes a secondary transfer roller 22, a belt tension roller 23, and a secondary transfer belt 24 extended by the secondary transfer roller 22 and the belt tension roller 23. At a position supported by the secondary transfer roller 22, the secondary transfer belt 24 is pressed to the support roller 16 via the intermediate transfer belt 10. Thus, a secondary transfer nip is formed between the secondary transfer belt 24 and the intermediate transfer belt 10.

The printing unit 100 further includes a fixing unit 25 next to the secondary transfer unit 29 as shown in FIG. 1. The fixing unit 25 fixes a toner image, which is transferred on a transfer sheet. The fixing unit 25 includes a fixing belt 26 (e.g., endless belt) and a pressure roller 27, in which the fixing belt 26 is pressed against the pressure roller 27. The secondary transfer unit 29 may include a sheet transport unit to transport a transfer sheet, having a toner image transferred at the secondary transfer nip, to the fixing unit 25.

The printing unit 100 further includes a sheet inverting unit 28 near the secondary transfer unit 29 and the fixing unit 25. The sheet inverting unit 28 is used to invert sheet faces of a transfer sheet to record images on both face of the transfer sheet. After a toner image is fixed on one face of a transfer sheet, the transfer sheet is fed to the sheet inverting unit 28 by switching a sheet path using a switch claw 55. Then, the transfer sheet is inverted and fed to the secondary transfer nip again to transfer another toner image on the other face of the transfer sheet. The transfer sheet is then ejected to a sheet ejection tray 57.

The scanner 300 includes a scan sensor 36 to scan image information of document placed on the contact glass 32, and transmits the scanned image information to the control unit.

Based on the image information transmitted from the scanner 300, the control unit sends a signal to a light source unit (e.g., laser, light emitting diode) installed in the optical writing unit 21 to control and emit a laser beam L with a given power to the photoconductor 3. With such a light irradiation process, an electrostatic latent image is formed on the photoconductor 3, and the latent image is then developed as a toner image by a development process.

The sheet feed unit 200 includes a sheet bank 43 disposed with a plurality of sheet cassettes 44, a feed roller 42, a separation roller 45, and a transport roller 47, for example. The feed roller 42 is used to feed a transfer sheet from the sheet cassette 44. The separation roller 45 separates the transfer sheet and fed the transfer sheet to a sheet path 46. The transport roller 47 transports the transfer sheet to a registration roller(s) 49 along a sheet route 48 in the printing unit 100.

The registration roller(s) 49 temporary stops the transfer sheet, fed from the sheet cassette 44 or a manual feed tray 51, and then feeds the transfer sheet to the secondary transfer nip set between the intermediate transfer belt 10 and the secondary transfer unit 29.

When conducting a copying operation (e.g., color image copying) by the image forming apparatus 500, a document sheet is set on a document tray 30 of the document feeder 400, or the document sheet is set on the contact glass 32 of the scanner 300 by opening the document feeder 400 and then closing the document feeder 400 to press the document sheet. Then a start button is pressed to scan image information of the document sheet. When the document sheet is set on the document feeder 400, the document sheet is automatically fed to the contact glass 32 to scan image information of the document sheet. When the document sheet is set on the contact glass 32 directly, a scanning operation starts immediately by pressing the start button. Specifically, in the scanning process, the scanner 300 is activated to move a first moving unit 33 and a second moving unit 34. A light is emitted from a light source of the first moving unit 33 to the document sheet, and a reflection light from the document sheet is guided to the second moving unit 34. Then, the reflection light is further reflected by a mirror of the second moving unit 34 and then enters a focus lens 35. Then, the light enters the scan sensor 36 to scan the image information of the document sheet.

The charge units 4K, 4Y, 4M, and 4C uniformly charge the photoconductors 3K, 3Y, 3M, and 3C, and then the optical writing unit 21 writes an electrostatic latent image of each color on the photoconductors 3K, 3Y, 3M, and 3C using a laser beam generated based on color information of the image information scanned by the scanner 300. An electrostatic latent image formed on the photoconductor 3C is developed as a C toner image by the development unit 5C. Similarly, M, Y, and K toner images are formed on the photoconductors 3M, 3Y, and 3K in the image forming units 1M, 1Y, and 1K. As such, the image forming process can be conducted in a similar manner for each of the color K (black), Y (yellow), M (magenta), and C (cyan).

While the toner images are formed on the photoconductors 3, the feed roller 42 is activated to feed a transfer sheet having a given size corresponding the scanned image information. Further, one of the support rollers 14, 15, and 16, connected to a drive motor, is activated by the drive motor to rotate the intermediate transfer belt 10 in a given direction. With a rotation of the intermediate transfer belt 10, the toner images formed on the photoconductors 3 are sequentially transferred to the intermediate transfer belt 10 to form a color image.

Meanwhile, in the sheet feed unit 200, one of the feed rollers 42 is rotated to feed a transfer sheet from one of the sheet cassettes 44, and then the separation roller 45 separates and feeds the transfer sheet to the sheet path 46. Then the transport roller 47 transports the transfer sheet to the sheet route 48 in the printing unit 100, and further transports the transfer sheet P to the registration roller(s) 49. In another case, a transfer sheet may be transported to the registration roller(s) 49 from the manual feed tray 51 by using a feed roller 50, a separation roller 52, and a feed route 53. Then, the registration roller(s) 49 is activated to feed the transfer sheet to the secondary transfer nip set between the intermediate transfer belt 10 and the secondary transfer roller 22 at a time corresponded to a color image forming process on the intermediate transfer belt 10. Then, the color image is transferred to the transfer sheet with an effect of a transfer electric field, a nip pressure at the secondary transfer nip.

The transfer sheet having the color image transferred at the secondary transfer nip is then fed to the fixing unit 25 by the secondary transfer belt 24 of the secondary transfer unit 29. In the fixing unit 25, the pressure roller 27 and the fixing belt 26 apply heat and pressure to the transfer sheet to fix the color image on the transfer sheet. After such a fixing process, the transfer sheet is ejected by an ejection roller 56 and stacked on the ejection tray 57. When images are formed on both faces of a transfer sheet, one color image is fixed on one face of the transfer sheet, and then transported to the sheet inverting unit 28 by switching the switch claw 55, then the transfer sheet is inverted and guided to the secondary transfer nip again to record another one color image on the other face of the transfer sheet, and then the transfer sheet is ejected to the ejection tray 57 by the ejection roller 56. Further, after transferring the color image to the transfer sheet at the secondary transfer nip, the belt cleaning unit 17 removes toner remaining on the intermediate transfer belt 10 to prepare the intermediate transfer belt 10 for a next image forming operation.

The image forming engines 1K, 1Y, 1M, and 1C have a similar configuration and operation one to another except the color of toner to be used. Therefore, the suffix letters of K, Y, M, and C may be omitted in this disclosure. FIG. 2 illustrates a schematic configuration of the image forming engine 1. As illustrated in FIG. 2, the image forming engine 1 may include a casing 2, the photoconductor 3, the charge unit 4, the development unit 5, and the cleaning unit 6, for example, and the image forming engine 1 may be an integrated unit, which integrates such units as a process cartridge so that the image forming engine 1 is detachably mountable to the image forming apparatus 500. With such a detachable configuration, the image forming engine 1 can be replaced as the process cartridge when an old one needs to be replaced with a new one. Further, each of sub-units of the image forming engine 1, such as for example the photoconductor 3, the charge unit 4, the development unit 5, and the cleaning unit 6, can be replaced separately when an old one needs to be replaced with a new one, which may be preferable for reducing waste of materials.

As illustrated in FIG. 2, the cleaning unit 6 includes a solid lubricant 64 and an application brush 62, for example. The solid lubricant 64 may be solidified lubricant such as for example zinc stearate, but not limited thereto. The application brush 62 is used to apply the lubricant on the photoconductor 3. The cleaning unit 6 includes a recovery vane 63, a cleaning blade 61, the application brush 62, and a smoothing blade 66, wherein such devices are positioned along a surface of the photoconductor 3 which can move in a given direction. For example, the recovery vane 63, the cleaning blade 61, the application brush 62, and the smoothing blade 66 are positioned along the surface of the photoconductor 3 from an upstream side of a surface moving direction of the photoconductor 3.

Figure 3:
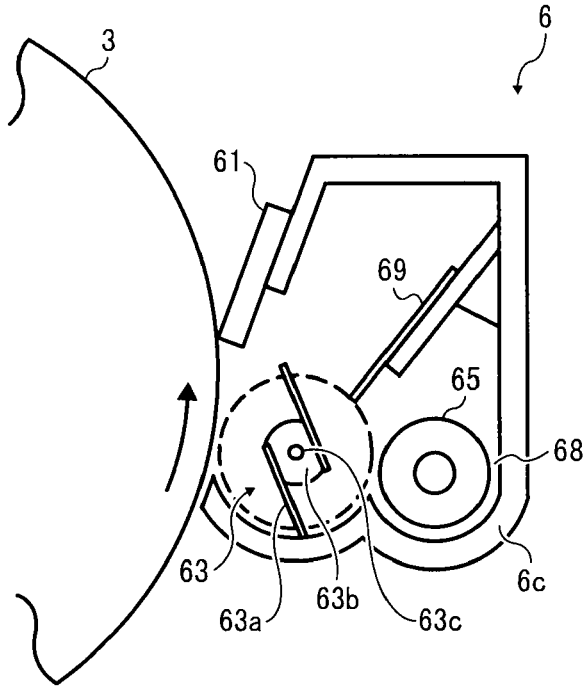
FIG. 3 illustrates a schematic configuration of a cleaning unit in the image forming engine of FIG. 2.

The cleaning blade 61 and the smoothing blade 66 may be a rubber blade, made of polyurethane rubber for example. In the cleaning unit 6, the recovery vane 63 rotates in a counterclockwise direction about a rotation axis 63*c* as shown in FIG. 3 by using a drive motor, for example. The recovery vane 63 and the cleaning blade 61 can be used to clean a surface of the photoconductor 3.

The solid lubricant 64 supported by a bracket is pressed against the application brush 62 by using a pressure spring. The application brush 62, which rotates at a given time, scrapes the solid lubricant 64 and applies the lubricant on the photoconductor 3. The lubricant is applied on the photoconductor 3 by the application brush 62 after the cleaning blade 61 removes toner remaining on the photoconductor 3 after a toner image transfer process. After applying the lubricant on the photoconductor 3, the smoothing blade 66 contacting the photoconductor 3 in a counter direction can smooth the lubricant applied on the photoconductor 3, by which the lubricant can be uniformly and precisely applied on the photoconductor 3.

The cleaning blade 61, supported by a holder pivotable at a given position, can contact the photoconductor 3 in a counter direction as shown in FIG. 2, for example. Toner removed from the photoconductor 3 by the cleaning blade 61 can be delivered to a toner recovery coil 65 by using the recovery vane 63, and then ejected to an outside of the cleaning unit 6 by the toner recovery coil 65.

In general, a cleaning unit can include a waste toner compartment in the cleaning unit to store waste toner or the like removed from a photoconductor. However, such cleaning unit may need to be replaced when the waste toner compartment becomes full of toner to its maximum storage capacity even if other parts or devices configuring the cleaning unit still have lifetime, wherein such a replacement condition is not preferable. If a storage capacity of the waste toner compartment is increased, a longer lifetime can be set for replacing the cleaning unit as a whole. However, if the cleaning unit becomes greater, it is not preferable from viewpoint of cost or occupying size.

In general, a cleaning unit can use a brush roller, which is placed at a downward direction of a cleaning blade contacting a photoconductor, in which the brush roller is placed at an upstream position of a surface moving direction of the photoconductor with respect to the cleaning blade. However, the brush roller may need a relatively complex manufacturing process such as for example winding and adhering brush fibers on a metal core, which may increase a manufacturing cost, by which not preferable. Further, although the brush roller may have a good performance as a cleaning assisting member, the brush roller may not have a good performance for delivering toner because toner particles may pass through spaces between the brush fibers.

Figure 4A:
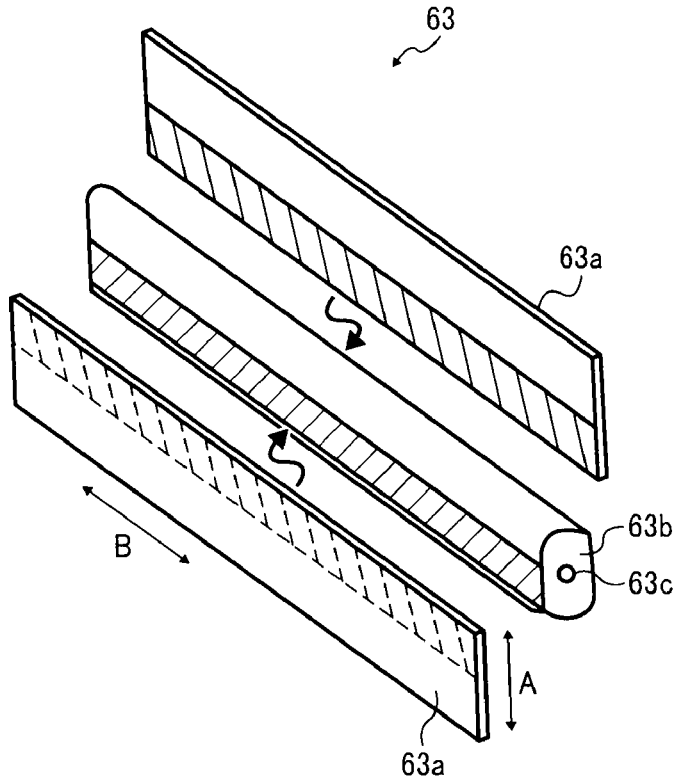
FIGS. 4A and 4B illustrate schematic views of components configuring a recovery vane used in the cleaning unit of FIG. 3.
Figure 4B:
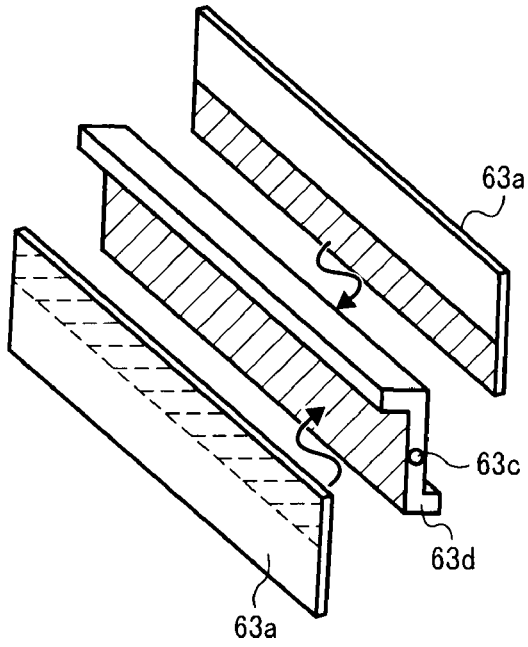

A description is now given of the cleaning unit 6 according to an exemplary embodiment with reference to FIGS. 3 and 4. FIG. 3 illustrates an expanded view of the cleaning unit 6, in which the solid lubricant 64, the application brush 62, and the smoothing blade 66 are omitted for the simplicity of drawing. FIGS. 4A and 4B illustrate components configuring the recovery vane 63.

As illustrated in FIG. 3, the toner recovery coil 65 and the toner recovery/transport route 68 are not positioned under a vertical direction extended from a contact position of the cleaning blade 61 and the photoconductor 3, wherein the toner recovery coil 65 exerts transport power in the toner recovery/transport route 68 to transport and eject toner outside the cleaning unit 6.

In such a configuration, the toner recovery coil 65 and the toner recovery/transport route 68 are disposed apart from the surface of the photoconductor 3. Accordingly, the toner recovery coil 65 and the toner recovery/transport route 68 are located in a position that is relatively distanced from the surface of the photoconductor 3 and the cleaning blade 61.

Due to such a configuration, the recovery vane 63 is disposed between the photoconductor 3 and the toner recovery coil 65 to deliver toner removed from the photoconductor 3 to the toner recovery coil 65. The recovery vane 63, disposed between the photoconductor 3 and the toner recovery coil 65, is used to deliver toner to the toner recovery coil 65.

The recovery vane 63 includes a vane to deliver toner. As illustrated in FIG. 4A, the recovery vane 63 includes an axis 63*b* and a vane 63*a*. The axis 63*b* may be made of metal and shaped in an oval-like or rectangular-like shape in cross-section, and the vane 63*a* may be a sheet member made of an elastic material. The vane 63*a* may be attached on the axis 63*b* with adhesives, for example, at a shaded area on the axis 63*b* in FIG. 4.

As illustrated in FIG. 4A, the vane 63*a* includes a short side in a diameter direction of the axis 63*b* (a direction A in FIG. 4A), and a long side in an axial direction of the axis 63*b* (a direction B in FIG. 4A). The vane 63*a*, made of an elastic material, rotates about the rotation axis 63*c* to transport waste materials, such as for example waste toner. Further, the recovery vane 63 may be configured in another way as illustrated in FIG. 4B, in which the recovery vane 63 includes a plate 63*d*, and the vane 63*a* attached on a plain face of the plate 63*d* with adhesives. The vane 63*a* may be a sheet member made of an elastic material, such as for example polyurethane rubber. Although the recovery vane 63 includes two vanes 63*a* as shown in FIGS. 4A and 4B, the number of vanes 63*a* of the recovery vane 63 is not limited to two. For example, the number of vane 63*a* of the recovery vane 63 may be one or more.

In the cleaning unit 6, waste materials, such as for example toner remaining on the surface of the photoconductor 3 after a transfer process, are removed by the cleaning blade 61 so as to separate the waste materials from the photoconductor 3, by which the waste materials may fall downward from the photoconductor 3 to the recovery vane 63. The recovery vane 63 rotates about the rotation axis 63*c* in a counter-clockwise direction, for example, wherein a space for a rotation of the recovery vane 63 is shown by dotted lines in FIG. 3. When the waste materials fall on the recovery vane 63, the waste materials may rotate with the recovery vane 63.

Further, the cleaning unit 6 includes a flicker 69 disposed at a position over the toner recovery/transport route 68. The flicker 69 can contact the vane 63*a* of the recovery vane 63. When the vane 63*a* impacts the flicker 69, a flicker movement occurs to the vane 63*a*, by which waste materials can be effectively delivered from the recovery vane 63 to the toner recovery coil 65.

The cleaning unit 6 includes the recovery vane 63 to deliver toner, removed from the photoconductor 3 by the cleaning blade 61, to the toner recovery coil 65 and the toner recovery/transport route 68. The recovery vane 63 can be manufactured by adhering and fixing the vane 63*a* (e.g., a sheet member) on the axis 63*b* having the rotation axis 63*c*, wherein such a configuration is simpler than a brush roller, and can be manufactured with less cost compared to the brush roller. Accordingly, compared to using the brush roller, waste materials, such as for example toner remaining on the photoconductor 3, can be delivered to the toner recovery/transport route 68 with a cost-reduced configuration.

In general, although a brush roller can deliver waste materials, a delivery performance of the brush roller may not be so high because toner particles may pass through spaces between brush fibers of the brush roller.

In contrast, in an exemplary embodiment, the cleaning unit 6 includes the recovery vane 63 to deliver waste materials. The vane 63*a* includes a short side in a diameter direction of the axis 63*b* (direction A in FIG. 4A), and a long side in an axial direction of the axis 63*b* (direction B in FIG. 4A). When the recovery vane 63 rotates about the rotation axis 63*c*, waste materials can be delivered in a direction farther away from the surface of the photoconductor 3. Because the vane 63*a* has a plane defined by the short and long sides (see FIGS. 4A and 4B), the vane 63*a* can exert a delivery force to the waste materials effectively, by which waste materials can be delivered efficiently compared to a brush roller having brush fibers because the waste materials may pass through spaces of the brush fibers.

With such a configuration of the recovery vane 63, the vane 63*a* impacts the flicker 69 at a frequency of one or more times for one rotation movement of the recovery vane 63. Such impacting is set so that the vane 63*a* can be used for delivering waste materials. The number of impacting can be determined by the number of the vane 63*a*. For example, in an exemplary embodiment, such impacting can occur two times per one rotation of the recovery vane 63 because the recovery vane 63 includes two vanes 63*a*. The number of the vanes 63*a* can be set other number, such as for example one, three, and so forth.

Such impacting at the flicker 69 may cause vibration to the cleaning unit 6 or the image forming engine 1 (used as a process cartridge), and such vibration may cause a shock jitter that causes image failures, in which images have an abnormal area in a periodical manner. Such a shock jitter may not become a problem for a monochrome image forming apparatus such as for example black and white image forming apparatus. However, such a shock jitter may cause a problem for a color image forming apparatus and a high-quality image forming apparatus. Accordingly, a configuration that can reduce or prevent a shock jitter is preferably designed for the cleaning unit 6, wherein a low cost manufacturing and higher delivery efficiency of the recovery vane 63 may be preferably achieved at the same time.

In an exemplary embodiment, the cleaning unit 6 includes the flicker 69, which impacts the recovery vane 63, made of an elastic material. By using an elastic material for the vane 63*a* (e.g., a sheet member) of the recovery vane 63 and the flicker 69, an impact shock occurring when the vane 63*a* impacts the flicker 69 can be reduced. The elastic material used for the vane 63*a* and the flicker 69 may be a sheet member made of polyurethane rubber, for example, but not limited thereto. A sheet member may be made of any elastic materials, such as for example polyethylene terephthalate (PET). From a viewpoint of higher durability, a sheet member made of polyurethane rubber may be used, for example. Accordingly, by using an elastic material having higher durability, the cleaning unit 6 can achieve a configuration having higher durability.

Figure 5:
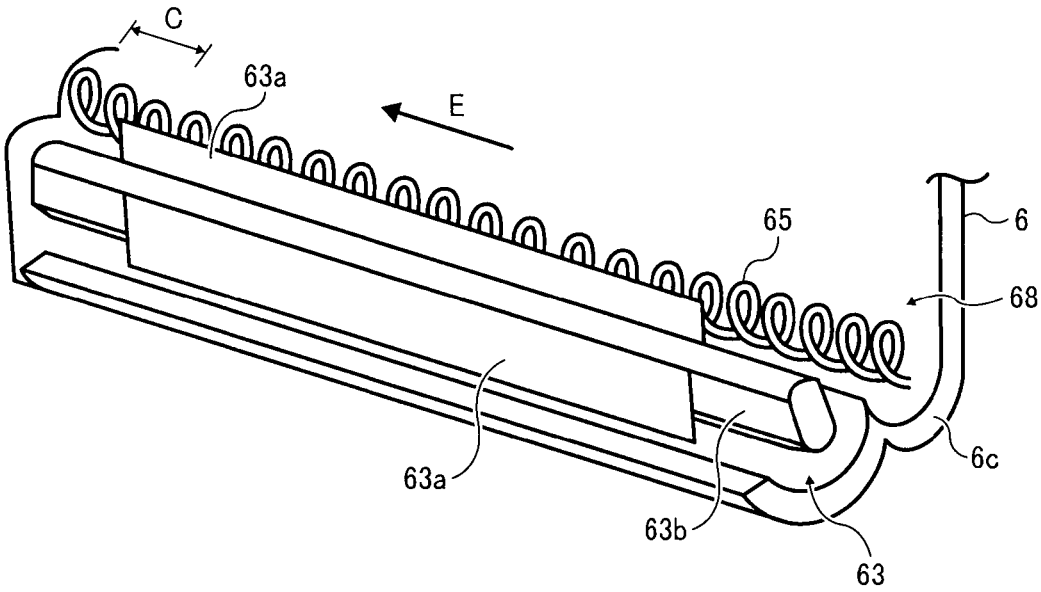
FIG. 5 illustrates a perspective view of the recovery vane and a toner recovery coil disposed in the cleaning unit of FIG. 3.
Figure 6:
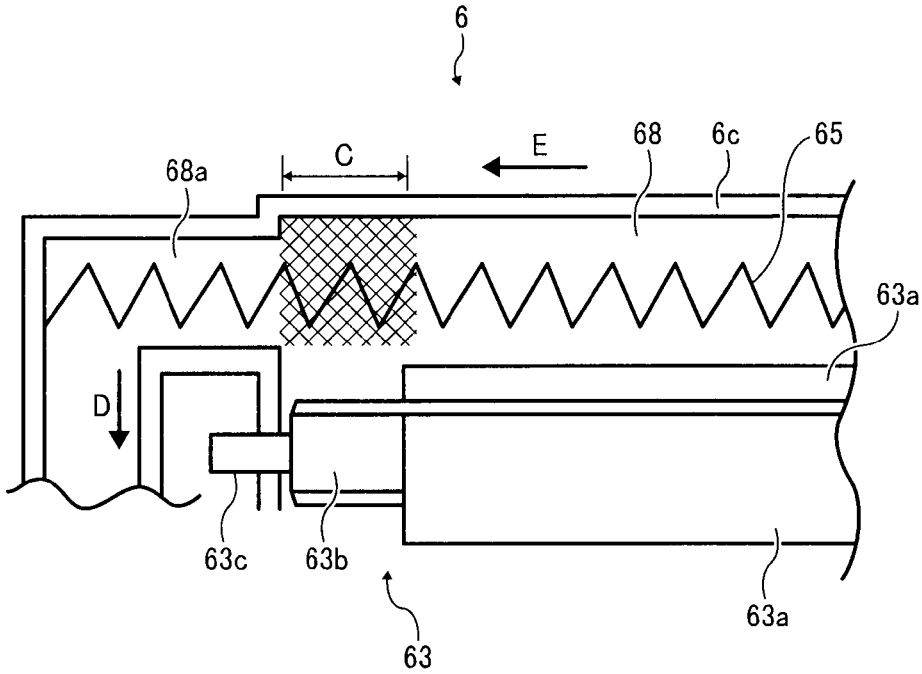
FIG. 6 illustrates an expanded plan view around an end portion of the cleaning unit, which corresponds to a downstream end area of the transport direction of the toner recovery coil.

A description is now given of a configuration in the cleaning unit 6 at a downstream area of transport direction of the toner recovery coil 65 with reference to FIGS. 5 and 6.

FIG. 5 illustrates a perspective view of the recovery vane 63 and the toner recovery coil 65 disposed in the cleaning unit 6. FIG. 6 illustrates a plan view of a downstream end of transport direction of the toner recovery coil 65 disposed in the cleaning unit 6.

Waste materials (e.g., remaining toner) delivered to the toner recovery/transport route 68 by the recovery vane 63 are further transported in a direction shown by an arrow E in FIGS. 5 and 6 by the toner recovery coil 65. When the waste materials are transported to a downstream end of transport direction of the toner recovery coil 65, the waste materials are ejected outside of a casing 6*c* of the cleaning unit 6 from a toner ejection port 68*a* provided on a wall of the casing 6*c*. The waste materials are ejected to the outside of the cleaning unit 6 in a direction shown by an arrow D in FIG. 6, and then transported to a waste toner recovery bottle by a waste toner transporter, for example. The direction shown by an arrow D is a downward direction in a real apparatus.

The toner recovery/transport route 68 may be shaped in a watershoot-like shape, in which the toner recovery coil 65 is installed and toner can be transported along the toner recovery/transport route 68 by rotating the toner recovery coil 65. In the toner recovery/transport route 68, waste materials (e.g., remaining toner) are transported in one given direction. Accordingly, an amount of waste materials at a downstream end of the transport direction becomes greater compared to an upstream end of the transport direction because waste materials transported from the upstream by the toner recovery coil 65 and waste materials delivered by the recovery vane 63 to the toner recovery coil 65 are mixed at the downstream end of the transport direction of the toner recovery coil 65.

If the toner has a lower fluidity and an amount of transported waste materials exceeds a given level, some waste materials may overflow from the toner recovery/transport route 68 to the recovery vane 63 by overflowing over a separation wall set between the toner recovery/transport route 68 and the recovery vane 63.

If the waste materials overflow to the recovery vane 63, such overflowed waste materials may contaminate the photoconductor 3 in the cleaning unit 6 by adhering on the photoconductor 3. If the overflowed waste materials may adhere on the photoconductor 3, the cleaning blade 61 cannot remove the waste materials effectively (e.g., waste materials may pass through the cleaning blade 61), and such passed-through waste materials may cause a cleaning failure and resultantly an image failure.

Such overflowing of waste materials from a toner recovery/transport route may not occur if a brush roller is employed instead of the recovery vane 63 because toner can be temporarily stored in spaces of brush fibers of the brush roller even if an amount of waste materials becomes greater.

On the other hand, in a configuration having the recovery vane 63, toner may not be temporarily stored in the recovery vane 63 if an amount of waste materials becomes greater, and a greater amount of waste materials may be delivered in the toner recovery/transport route 68 in a shorter time, by which the above described overflowing from the toner recovery/transport route 68 may occur.

Figure 7:
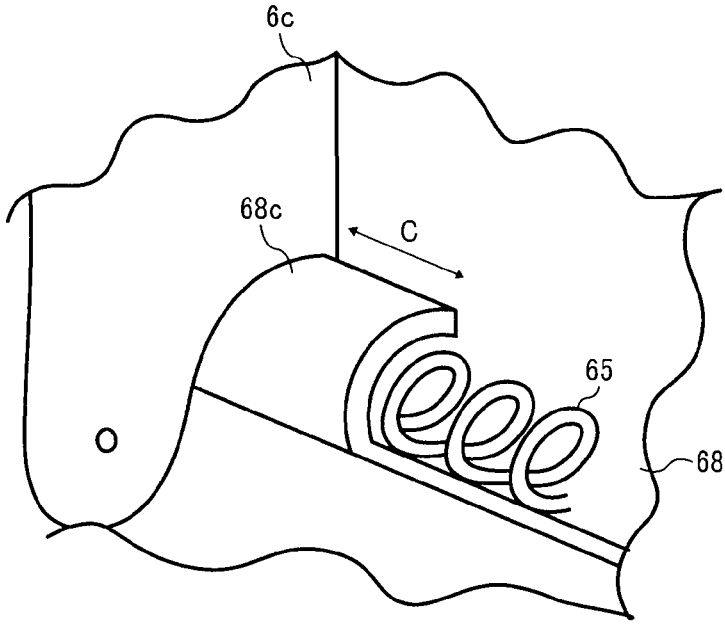
FIG. 7 illustrates an expanded perspective view around an end portion of the cleaning unit, which corresponds to a downstream end area of the transport direction of the toner recovery coil, and the end portion of the cleaning unit is covered by a cover.

In an exemplary embodiment, the cleaning unit 6 includes an area C shown by an arrow in FIGS. 5 and 6, to which waste materials are not delivered to the toner recovery/transport route 68 from the recovery vane 63. As illustrated in FIG. 7, in an exemplary embodiment, the cleaning unit 6 can include a cover 68*c* at a downstream end of the transport direction of the toner recovery coil 65 to cover the area C, by which waste toner is not delivered from the recovery vane 63 of the toner recovery coil 65 at the area C. Specifically, the cover 68*c* covers a meshed area shown in FIG. 6. With such a configuration that the cover 68*c* is disposed at a downstream end of the transport direction of the toner recovery/transport route 68, such a covered area becomes a tunnel-like area for the toner recovery/transport route 68. Accordingly, the above described overflowing from the toner recovery/transport route 68 at the area C can be prevented.

A description is now given of transport performance of the toner recovery coil 65. As above described, in the toner recovery/transport route 68, waste materials (e.g., remaining toner) are transported in one direction. Accordingly, an amount of waste materials at a downstream end area of the transport direction becomes greater compared to an upstream end area of the transport direction because waste materials transported from the upstream by the toner recovery coil 65 and waste materials delivered by the recovery vane 63 are mixed at the downstream end, and then some waste materials may overflow from the toner recovery/transport route 68 to the recovery vane 63. Such an inconvenient situation may be prevented by smoothly ejecting the waste materials from the cleaning unit 6. Specifically, a transport performance of the toner recovery coil 65 can be enhanced at a downstream end area of the transport direction of the toner recovery coil 65 as follows.

Figure 8:
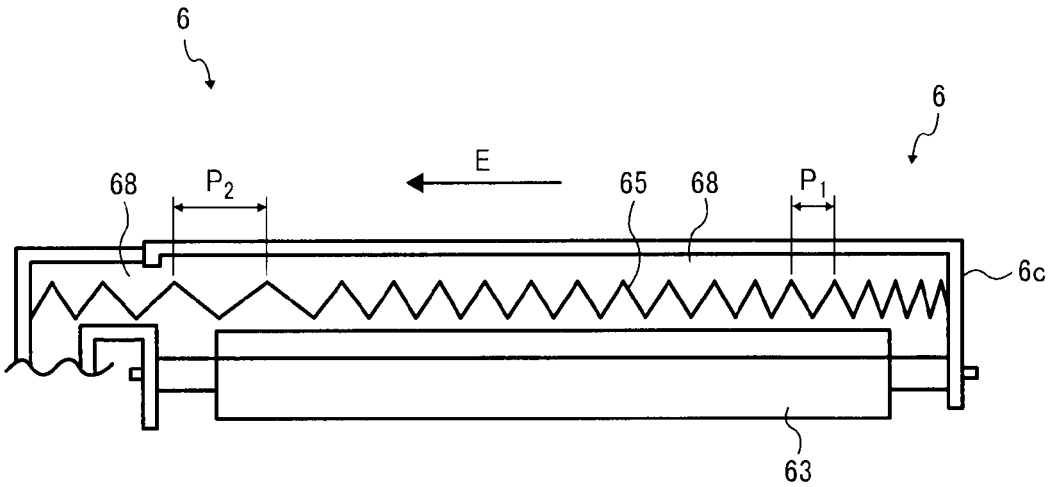
FIG. 8 illustrates another configuration for a toner recovery coil for enhancing a transport performance of the toner recovery coil at a downstream end area of the transport direction.

FIG. 8 illustrates one example configuration of the toner recovery coil 65 for enhancing transport performance of the toner recovery coil 65 at a downstream end area of the transport. As illustrated in FIG. 8, the cleaning unit 6 includes the toner recovery coil 65 which has varied coil pitches along its entire length. As shown in FIG. 8, the coil pitch can be set longer and longer as the toner recovery coil 65 is closer to the toner ejection port 68*a*. The recovery coil 65 may have a cross-sectional shape of a flat plate, for example.

Specifically, along a transport direction of the toner recovery coil 65 (a direction of an arrow E in FIG. 8), a downstream side pitch P2 of the toner recovery coil 65 is set greater than an upstream side pitch P1 of the toner recovery coil 65. The pitch can be changed gradually from the upstream to downstream side of the toner recovery coil 65, or the pitch can be changed incrementally from the upstream to downstream side of the toner recovery coil 65 by segmenting the toner recovery coil 65 in several segments of a given length. Further, the toner recovery coil 65 can have a cross-sectional shape of a round shape, for example, and can be made of resin material. For example, in the cleaning unit 6, the upstream side pitch P1 may be set to 6 mm, and the downstream side pitch P2 may be set to 8 mm. The pitch of the recovery coil 65 can be determined based on information of an amount of waste toner at the upstream and downstream side in the recovery/transport route 68 obtained from operation testing of an actual apparatus.

Further, the configuration including the cover 68*c* (see FIG. 7) and the configuration including the toner recovery coil 65 having a wider pitch at a downstream end area of the transport direction (see FIG. 8) can be combined to reduce or prevent overflowing of waste materials more effectively and to eject waste materials (e.g., remaining toner) efficiently.

In the above description, the cleaning unit 6 uses the cleaning blade 61 as a cleaning member contacted to an object to be cleaned, such as for example a photoconductor, but other cleaning member can be used. For example, instead of the cleaning blade 61, a brush roller can be contacted to an object to be cleaned to remove and drop waste materials toward an upstream direction of a surface movement direction of the object to be cleaned. If the brush roller having a configuration for scraping and dropping waste materials is used as a cleaning member, a delivery device for delivering waste materials to a toner recovery/transport route may be omitted, by which the brush roller can be designed in various shapes and the number of layout patterns can be increased.

In an exemplary embodiment, by delivering waste materials using the recovery vane 63, the waste materials can be delivered efficiently compared to a configuration using a brush roller for delivering the waste materials to the toner recovery coil 65. Further, the recovery vane 63 can be positioned in a non-contact condition with the photoconductor 3 as illustrated in FIG. 3, but can be positioned in a contact condition with the photoconductor 3. Further, instead of using the toner recovery coil 65, a screw type ejector can be also used, in which helical vanes are wound on a rod. Such toner recovery coil 65 can be referred as an ejection auger.

In an exemplary embodiment, four photoconductors corresponding to four toner colors are used and the cleaning unit 6 is provided for each of the four photoconductors. However, the cleaning unit 6 can be used other configurations of photoconductor or image forming engines. For example, if an object to be cleaned is a photoconductor of a monochrome image forming apparatus, the cleaning unit 6 can be used for such a photoconductor. If a color image forming apparatus has one photoconductor and a plurality of development units facing the one photoconductor, the cleaning unit 6 can be used for such photoconductor, in which four toner color images are formed on the one photoconductor.

Further, the cleaning unit 6 can be used for any objects to be cleaned in addition to a photoconductor. For example, the cleaning unit 6 can be used for an intermediate transfer member, such as for example an intermediate transfer belt, or a transport belt transporting a transfer sheet from an image transfer nip to a fixing unit.

In an exemplary embodiment, the cleaning unit 6 includes the cleaning blade 61, which can contact a surface of the photoconductor 3 (an object to be cleaned). The cleaning blade 61 cleans the surface of the photoconductor 3 by removing waste materials, such as for example toner, on the photoconductor 3 at such a contact portion.

Further, the cleaning unit 6 includes the toner recovery coil 65 to transport and eject waste materials removed from the surface of the photoconductor 3 by the cleaning blade 61 to outside of the cleaning unit 6.

Further, the cleaning unit 6 includes the recovery vane 63 including the vane 63*a* and the rotation axis 63*c*. The recovery vane 63 delivers waste materials to the toner recovery/transport route 68 installed with the toner recovery coil 65 that transports the waste materials in one direction. The vane 63*a* rotates about the rotation axis 63*c* to deliver waste materials to the toner recovery/transport route 68. The recovery vane 63 can be manufactured by fixing the vane 63*a* on the axis 63*b*, which is a configuration simpler than a configuration of a brush roller and thereby the recovery vane 63 can be manufactured reduced cost compared to the brush roller. Further, the vane 63*a* can deliver waste materials in a direction farther away from the surface of the photoconductor 3 because the vane 63*a* rotates about the rotation axis 63*c* that is parallel to a rotation axis of the photoconductor 3. Further, the recovery vane 63 can be set in a position that can receive waste materials, removed by the cleaning blade 61 and dropped from the cleaning blade 61, and can deliver the waste materials to the toner recovery/transport route 68. Accordingly, in the cleaning unit 6, waste materials cleaned by the cleaning blade 61 can be delivered to the toner recovery/transport route 68 with a configuration, which is less expensive than a brush roller.

Further, the vane 63*a* and the flicker 69 can be made of an elastic material, by which a flicker movement (or impact shock) of the vane 63*a*, which may occur when the vane 63*a* impacts the flicker 69, can be reduced. If the impact shock becomes great, vibration caused by the impact shock may be transmitted to the photoconductor 3, the development unit 5, or the like, and such vibration may cause a shock jitter that causes image failure, in which an image has abnormal area in a periodical manner. Accordingly, by reducing the impact shock of the vane 63*a* and the flicker 69, such a shock jitter can be reduced or prevented.

Further, as illustrated in FIG. 4A, the vane 63*a* includes a short side in a diameter direction of the axis 63*b* (direction A in FIG. 4A), and a long side in an axial direction of axis 63*b* (direction B in FIG. 4A). The vane 63*a*, made of an elastic material, rotates about the rotation axis 63*c* to deliver waste materials, such as for example waste toner. The vane 63*a* may have a plate shape. Because of such plate shape, the waste materials can be delivered effectively and efficiently compared to a brush roller because waste materials may pass through spaces between brush fibers.

Further, the cleaning blade 61 can be contacted to the photoconductor 3 with one side of the cleaning blade 61, wherein such one side of the cleaning blade 61 extends in a direction perpendicular to a surface movement of the surface of the photoconductor 3. As such, a simpler configuration can be used for cleaning the photoconductor 3.

Further, the cleaning blade 61, the vane 63*a* and the flicker 69 can be made of an elastic material, such as for example polyurethane rubber having higher durability, by which a higher durability can be achieved for the cleaning unit 6.

Further, the toner recovery coil 65 can be used to transport and eject waste materials outside the cleaning unit 6. The toner recovery coil 65, having a helical part, can be used as an ejection auger. By using a coil as the ejection auger, toner can be ejected with a simple configuration and less occupying space, which is a space saving configuration.

Further, the toner recovery/transport route 68 is formed by shaping a watershoot-shape in the casing 6*c*, in which the toner recovery coil 65 is installed. An area over the toner recovery/transport route 68 for receiving waste materials from the recovery vane 63 is an open space so as to deliver waste materials from the vane 63*a* to the toner recovery coil 65. Further, the cover 68*c* covers an area which is at a downstream end of transport direction of the toner recovery coil 65 (the area C in FIG. 7), by which overflowing of waste materials from the toner recovery/transport route 68 can be prevented.

Further, as illustrated in FIG. 8, the cleaning unit 6 includes the toner recovery coil 65 which has varied coil pitches along its entire length. The coil pitch can be set longer and longer as the toner recovery coil 65 is closer to the toner ejection port 68*a*. Specifically, along a transport direction of the toner recovery coil 65, the downstream side pitch P2 of the toner recovery coil 65 can be set greater than the upstream side pitch P1 of the toner recovery coil 65. With such a configuration, a transport performance of the toner recovery coil 65 can be enhanced at a downstream end area of the transport direction of the toner recovery coil 65, by which waste materials can be smoothly ejected from the cleaning unit 6, and thereby overflow of waste materials from the toner recovery/transport route 68 can be prevented.

Further, the image forming apparatus 500 includes the photoconductor 3 as a latent image carrier, the charge unit 4 for uniformly charging the surface of the photoconductor 3, and the optical writing unit 21 for writing an electrostatic latent image on the photoconductor 3. Further, the image forming apparatus 500 includes the development unit 5 for developing the electrostatic latent image on the photoconductor 3 as a toner image, and the primary transfer roller 8 for transferring the toner image from the photoconductor 3 to the intermediate transfer belt 10 (a transfer member). Further, the image forming apparatus 500 includes the cleaning unit 6 for removing toner remaining on the surface of the photoconductor 3 after an image transfer process. Because waste materials can be delivered to the toner recovery/transport route 68 effectively and the waste materials can be transported in the toner recovery/transport route 68, an amount of waste materials (e.g., toner) in the cleaning unit 6 may not increase to a level that overflowed toner adheres on the photoconductor 3. Accordingly, a good cleaning performance can be maintained for the image forming apparatus 500.

Further, the image forming engine 1 can be integrated with the photoconductor 3 and the cleaning unit 6 as a process cartridge detachably mountable to the image forming apparatus 500, by which a replacement or maintenance work of units (e.g., photoconductor 3) can be conducted efficiently by removing the process cartridge from the image forming apparatus 500.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A cleaning unit, comprising:

a cleaning member that contacts a surface of an object to be cleaned that moves in a given direction, the cleaning member configured to remove waste material from the surface of the object to be cleaned;

an ejection member, disposed apart from the surface of the object to be cleaned and configured to transport the waste material removed from the object to be cleaned by the cleaning member to outside of the cleaning unit;

a delivering member configured to deliver the waste material removed from the object to be cleaned by the cleaning member to a transport-effective area of the ejection member, the delivering member including a rotating device including a rotation axis, the rotation axis extending in a direction perpendicular to a surface moving direction of the object to be cleaned, and the rotating device being configured to rotate to deliver the waste material to the ejection member; and a transport compartment in which the ejection member is disposed, wherein the transport compartment is communicable with the delivering member, separated from the transport compartment with a wall therebetween, via an open space set over the transport compartment and the delivering member, the waste material is delivered from the delivering member to the ejection member in the transport compartment through the open space, and the transport compartment includes a cover configured to cover a downstream end side of the ejection member in the transport compartment.

2. The cleaning unit according to claim 1, wherein the cleaning member traps the waste material upstream from a contact position where the cleaning member contacts the object to be cleaned with respect to a moving direction of the object to be cleaned, removes the waste material from the surface of the object to be cleaned.

3. The cleaning unit according to claim 1, wherein the delivering member includes a plate-shaped member having a short side in a diameter direction of the rotating device and a long side in a direction of the rotation axis of the rotating device.

4. The cleaning unit according to claim 1, wherein the cleaning member includes a cleaning blade including one side extending in a direction perpendicular to a surface movement direction of the object to be cleaned, and the one side of the cleaning member is contactable to the surface of the object to be cleaned.

5. The cleaning unit according to claim 1, wherein, the cleaning member is at least partially formed of polyurethane rubber.

6. The cleaning unit according to claim 1, wherein the delivering member is at least partially formed of polyurethane rubber.

7. The cleaning unit according to claim 1, wherein the ejection member includes an ejection auger comprising a shaft and a helical vane attached to the shaft, and the ejection auger transports and ejects the waste material outside the cleaning unit by transporting the waste material in a direction perpendicular to the surface movement direction of the object to be cleaned by rotating the shaft and the helical vane.

8. The cleaning unit according to claim 7, wherein the helical vane of the ejection auger has a varied pitch width in a direction of the rotation axis of the ejection auger.

9. The cleaning unit according to claim 8, wherein the pitch width of the helical vane at a downstream end side of the ejection auger is greater than a pitch width of the helical vane at an upstream end side of the ejection auger.

10. An image forming apparatus, comprising:

a latent image carrier;

a charge unit configured to charge the latent image carrier;

a latent image writing unit configured to write an electrostatic latent image on the latent image carrier;

a development unit configured to develop the electrostatic latent image on the latent image carrier as a toner image using toner;

a transfer unit configured to transfer the toner image from the latent image carrier to a transfer member; and the cleaning device according to claim 1, configured to remove toner remaining on the latent image carrier after transferring the toner image to the transfer member.

11. An image carrying unit detachably mounted in an image forming apparatus, comprising:

an image carrier; and the cleaning unit according to claim 1, configured to clean a surface of the image carrier, the image carrier and the cleaning unit being integrated.

12. The cleaning unit according to claim 1, wherein the delivering member includes, in place of the rotating device, a vane rotating device which includes a rotation axis, and a vane, the rotation axis extending in a direction perpendicular to a surface moving direction of the object to be cleaned, and the vane being made of an elastic material and attached on the rotation axis.

13. The cleaning unit according to claim 12, further comprising:

a flicker, made of an elastic material and configured to contact a free end of the vane to cause a flicker movement to the vane at a position over the transport-effective area of the ejection member, the flicker at least partially being formed of polyurethane rubber.

14. A cleaning unit, comprising:

a cleaning member that contacts a surface of an object to be cleaned that moves in a given direction, the cleaning member configured to remove waste material from the surface of the object to be cleaned;

an ejection member, disposed in an area distanced from the surface of the object to be cleaned and configured to transport the waste material removed from the object to be cleaned by the cleaning member to outside of the cleaning unit;

a delivering member, configured to deliver the waste material removed from the object to be cleaned by the cleaning member to a transport-effective area of the ejection member, the delivering member including a vane rotating device including a rotation axis and a vane, the rotation axis extending in a direction perpendicular to a surface moving direction of the object to be cleaned and the vane being made of an elastic material and attached to the rotation axis, and the vane rotating device being configured to rotate to deliver the waste material to the ejection member; and a transport compartment in which the ejection member is disposed, wherein the transport compartment is communicable with the delivering member, separated from the transport compartment with a wall therebetween, via an open space set over the transport compartment and the delivering member, the waste material is delivered from the delivering member to the ejection member in the transport compartment through the open space, and the transport compartment includes a cover configured to cover a downstream end side of the ejection member in the transport compartment.

* * * * *